US005092007A

United States Patent [19]

Hasty

[11] Patent Number: 5,092,007

[45] Date of Patent: Mar. 3, 1992

[54] AIR MATTRESS OVERLAY FOR LATERAL PATIENT ROLL

[76] Inventor: Charles E. Hasty, Box 185, Carrollton, Tex. 75006

[21] Appl. No.: 660,519

[22] Filed: Feb. 21, 1991

[51] Int. Cl.[5] ..... A61G 7/04

[52] U.S. Cl. ..... 5/453; 5/455

[58] Field of Search ..... 5/449, 446, 453, 455, 5/463

[56] References Cited

U.S. PATENT DOCUMENTS

| | | | |
|---|---|---|---|
| 1,526,211 | 3/1926 | O'Kane | 5/455 |
| 3,477,071 | 11/1969 | Emerson | 5/61 |
| 3,485,240 | 12/1969 | Fountain | 5/61 X |
| 3,895,403 | 7/1975 | Davis | 5/61 X |
| 3,935,604 | 2/1976 | Collins | 5/61 X |
| 4,941,221 | 7/1990 | Kanzler | 5/61 X |
| 4,977,629 | 12/1990 | Jones | 5/61 |

FOREIGN PATENT DOCUMENTS

| | | | |
|---|---|---|---|
| 958651 | 5/1964 | United Kingdom | 5/455 |

*Primary Examiner*—Michael F. Trettel

*Attorney, Agent, or Firm*—Ross, Howison, Clapp & Korn

[57] ABSTRACT

An air movement overlay system including a pair of parallel main rolling chambers arranged under the patient's torso. Auxiliary rolling chambers overlie each main rolling chamber. Constant pressure inflation head rest, leg separation chamber, and outrigger chambers are provided. The system is automatically controlled to establish the patient alternately in roll right and roll left positions, interspersed with neutral positions. In preparation for rolling, both main rolling chambers are inflated to a pressure of at least about 65% of the maximum main rolling chamber inflation pressure. The main rolling chambers are spaced apart and connected by a central uninflated web.

8 Claims, 5 Drawing Sheets

AIR MATTRESS OVERLAY FOR LATERAL PATIENT ROLL

TECHNICAL FIELD OF THE INVENTION

This invention relates to air operated movement overlays for patient beds, and more particularly to an air mattress overlay useful in conjunction with conventional bed mattresses for automatically rolling a patient to the left and right in accordance with a preselected time sequence.

BACKGROUND OF THE INVENTION

A common practice in the care of immobilized, bedridden patients is the rotation of a patient on his side and the propping of him in that position with pillows. The patient is periodically moved between a neutral or flat position and rolled positions to both his right and left side. Such care reduces the tendency for fluid accumulation in a single spot in the lungs. It also has skin care benefits in reducing the tendency to pressure sores.

The effecting of such movements automatically has been proposed in conjunction with air support beds for patients at high risk from pressure sores. PTO application WO 88/09651, published Dec. 15, 1988, illustrates an air support bed available commercially from Kinetic Concepts, Inc. which incorporates a series of odd shaped air pillows in an air support bed to serve both the basic function of reduced pressure air support and automatic adjustment of the patient's rotational orientation. A simpler system for effecting rolling in conjunction with an air support bed is illustrated in my U.S. Pat. No. 4,953,247.

It has also been proposed to provide automatic rolling overlays in conjunction with conventional mattresses. U.S. Pat. Nos. 3,477,071, 3,775,781, 3,415,240, and 4,941,221, as well as U.K. Patent 2,026,315 and German Patent 2816642, are examples of such overlay systems which have been proposed for use atop conventional bed mattresses. Despite these latter proposals, the utilization of air operated overlays in conjunction with conventional mattresses has not become a wide spread practice. It is believed in part that the problems of such overlays when used with conventional mattresses include the fact that the patient is subject to feelings of insecurity in the angled position, as well as the fact that the patient may effectively be "wedged" up into the angled position, producing shear on the shoulder. Moreover, the patient may, in part, be slid from side to side on the bed rather than merely being rotated in place.

Accordingly, despite the considerable attention which has been directed to the air operation of patient rotational orientation systems, there remains a need for a simple system which can be used both on top of conventional mattresses and air support beds which will effectively produce the desired automatic adjustment of the patient's rotational orientation in a comfortable and stable manner with minimum shear, while not creating patient anxiety. It is believed that the overlay system of this invention represents a substantial advance over the state of this art.

SUMMARY OF THE INVENTION

In accordance with the invention, there is provided a patient rolling overlay mattress system which may be utilized with a conventional bed. The system includes an air source and an overlay including left and right parallel main rolling chambers extending longitudinally at least the length of a patient's torso. Preferably the main rolling chambers are spaced apart at least two inches by a central uninflatable web connecting the two chambers. The overlay includes a pair of outrigger chambers, each of which extends along the outside of a main rolling chamber. A leg separation chamber extends centrally of the overlay longitudinally downwardly from the lower end of the web separating the main rolling chambers. A pair of leg support chambers located on each side of the leg separation chamber comprise an extension of a main rolling chamber. Control means connected to the air source and the overlay is provided for directing air to and from the chambers in the overlay. The control means at first times deflates the left main rolling chamber while inflating the right main rolling chamber, and at second times inflates the left main rolling chamber while deflating the right main rolling chamber, and at both said first and second times maintains inflation of the leg separation chamber and at least one outrigger chamber. Preparatory to the rolling of the patient at such first and second times, the control means establishes a partial inflation of both main rolling chambers, each being established at a substantially equal pressure of at least about 65% of the full inflation pressure of the main rolling chambers. This preparation stage improves the nature of the subsequent rotation, minimizing shear from "wedging".

In a further aspect of the invention, a pair of auxiliary rolling chambers is provided in the overlay with one overlying each main rolling chamber. The user may select inflation of an auxiliary rolling chamber to increase the angle of patient roll. In accordance with the invention, a preprogrammed cycle is established wherein the patient is positioned in a flat or neutral orientation between each of the first and second times. In the neutral position, the patient is initially supported only by the mattress, with the main rolling chambers being uninflated. Before moving to rolling phase, a preparation phase in which the patient remains flat is provided by inflation of both of the main rolling chambers to partial inflation pressure of at least about 65% of the full inflation pressure of the chambers.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
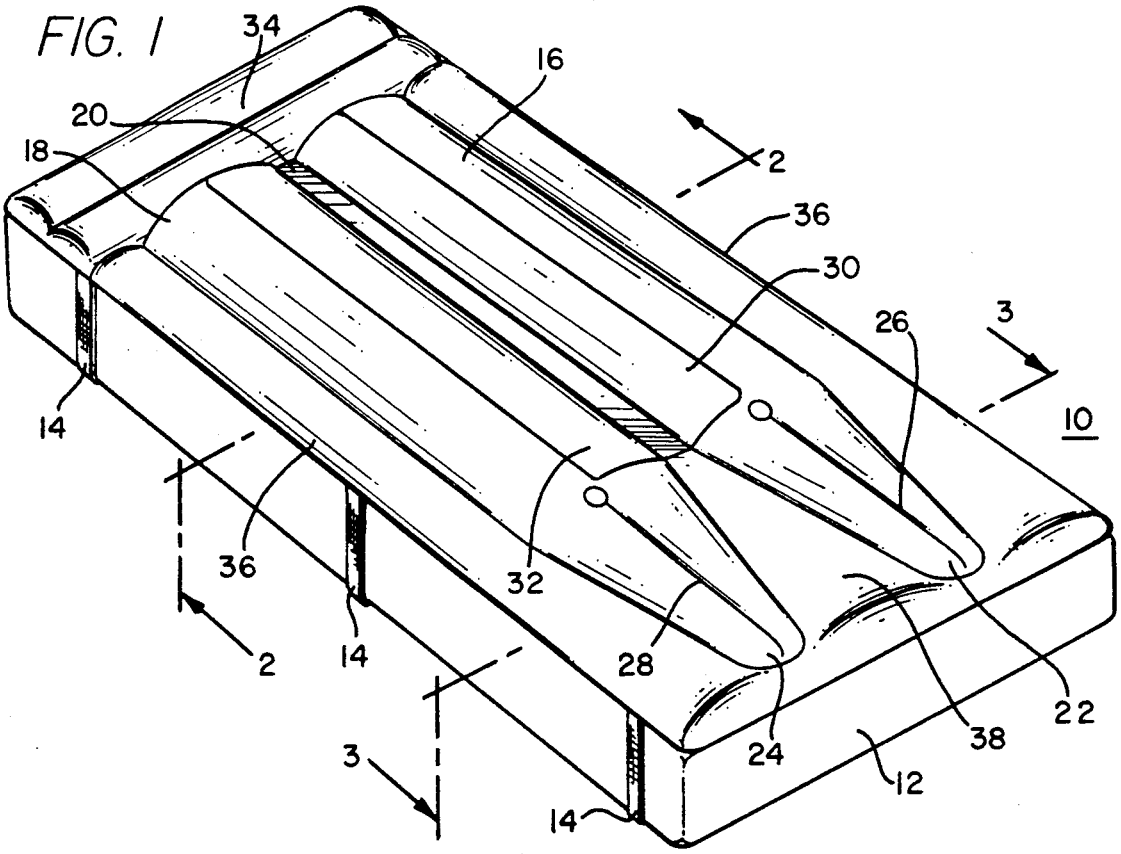
FIG. 1 is a perspective view of an overlay constructed in accordance with the invention, with both main rolling chambers partially inflated in preparation for turning.
Figure 2:
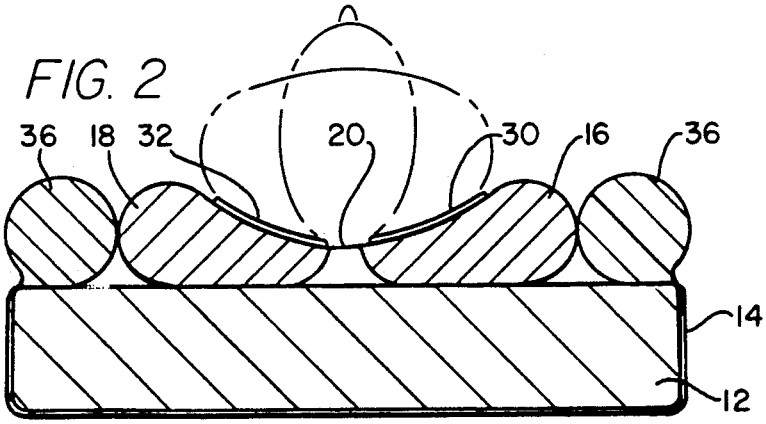
FIG. 2 is a cross-sectional view taken along line 2—2 in FIG. 1, showing the patient in phantom.
Figure 3:
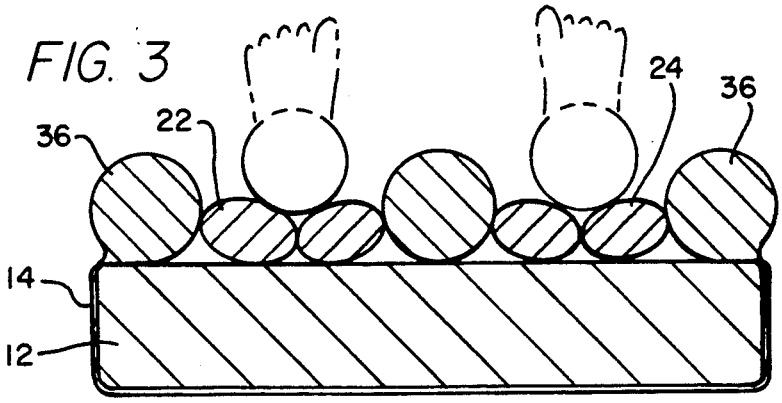
FIG. 3 is a cross-sectional view taken along line 3—3 in FIG. 1, showing the patient in phantom.

An air operated overlay constructed in accordance with the invention is shown with inflation or partial inflation of its several chambers, saving only auxiliary rolling chambers, in FIGS. 1 through 3. The overlay 10 is shown atop a conventional bed mattress 12, secured by straps 14. Overlay 10 may be formed from any suitable material used for conventional air mattresses. One suitable material is a nylon to the inside of which a heat sealable urethane coating is applied. The various chambers in overlay 10 may then be formed by heat sealing of the urethane lining.

The principle rolling action of overlay 10 is provided by left main rolling chamber 16 and right main rolling chamber 18. The main rolling chambers 16 and 18 extend longitudinally of overlay 10 at least the length of a patient torso, and are spaced from the center line of overlay 10 a short distance. Uninflatable web portion 20 between rolling chambers 16 and 18 has a width in the range of about 2 to 5 inches. At the larger end of the range of width for web 20, maximum protection for sacral ulcers is provided. Also, the wide web reduces the possibility of the patient being rolled over the crown of a rolling chamber to the edge of the bed. Reducing the width of web 20 increases the angle of rotation achieved by a given inflation of the rolling chambers.

Left and right leg support chambers 22 and 24, respectively, extend longitudinally downwardly from the lower ends of the main rolling chambers 16 and 18. The support chambers 22 and 24 are bifurcated along central seal lines 26 and 28. Support chambers 22 and 24 are extensions of chambers 16 and 18, so that they are inflated or deflated at the same time as their corresponding main rolling chambers. Left and right auxiliary rolling chambers 30 and 32 overlie main rolling chambers 16 and 18, extending from approximately the juncture of each main rolling chamber with central uninflatable web 20 outwardly for about ½ the width of each main rolling chamber. These auxiliary chambers make it possible to increase the angle of patient roll if desired.

Although the foregoing chambers 16, 18, 22, 24, 30 and 32 are typically inflated and deflated in usage of the overlay to carry out rolling of the patient, the remaining chambers in overlay 10 are generally maintained at a constant inflation throughout use. At the upper end of main rolling chambers 16 and 18 are head rest chambers 34 extending traversely across the top of overlay 10. Longitudinally extending along the edges of overlay 10 outside of the main rolling chambers 16 and 18 are outrigger chambers 36. Outrigger chambers 36 are part of a common chamber which includes leg separation chamber 38 extending between leg support chambers 22 and 24, and terminating at the lower end of web 20.

Figure 4:
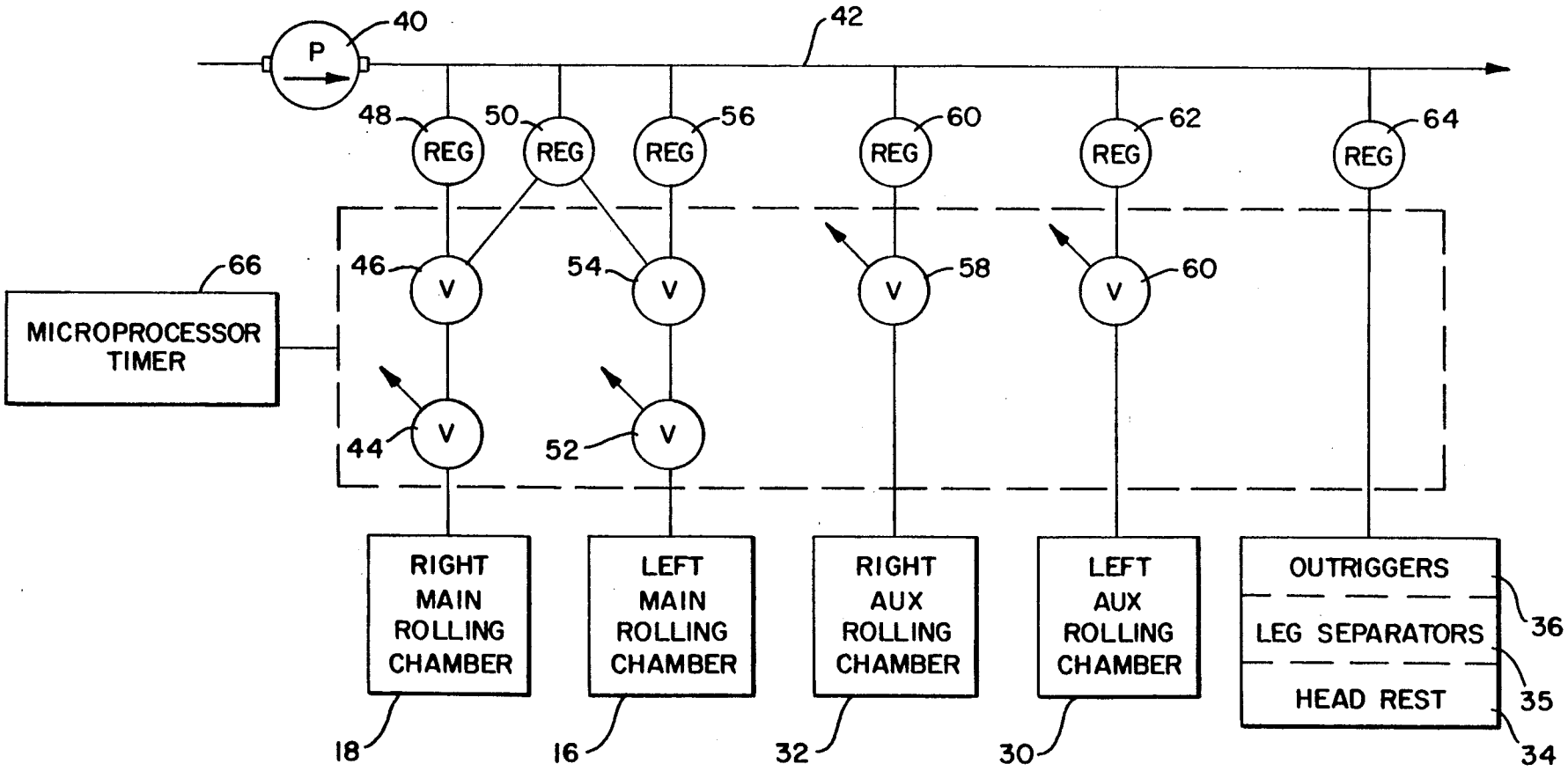
FIG. 4 is a schematic of an air circuit for the overlay in accordance with the invention.

Circuitry for managing movement of the patient utilizing overlay 10 is illustrated schematically in FIG. 4. An air flow source such as pump 40 provides a constant stream of pressurized air to line 42. The chambers of overlay 10 are connected by valves and pressure regulators to the pressurized air in line 42. Right main rolling chamber 18 is connected to a two position valve 44. Valve 44 connects the inlet of right main rolling chamber 18 either to atmosphere for deflation, or to a second valve 46. Valve 46 connects to line 42 alternatively through either maximum roll pressure regulator 48 or roll preparation pressure regulator 50. Main rolling chamber 16 is similarly connected through two position valve 52 to either atmosphere or value 94. Valve 54 is connected to line 42 through either maximum roll pressure regulator 56 or roll preparation pressure regulator 50.

Right auxiliary roll chamber 32 is connected to two position valve 58 to either atmosphere or through auxiliary roll pressure regulator 62, to line 42. Left auxiliary rolling chamber 30 is similarly connected through two position valve 63 to either atmosphere or auxiliary roll pressure regulator 62.

The constant pressure chambers 34, 36 and 38 are connected without valving through pressure regulator 64 to line 42. All of the control valves 44, 46, 52, 54, 58 and 60 may be two position solenoid operated valves under the control of microprocessor/timer 66 to effect automatic control of patient orientation by timed sequencing of valve movements.

Figure 5:
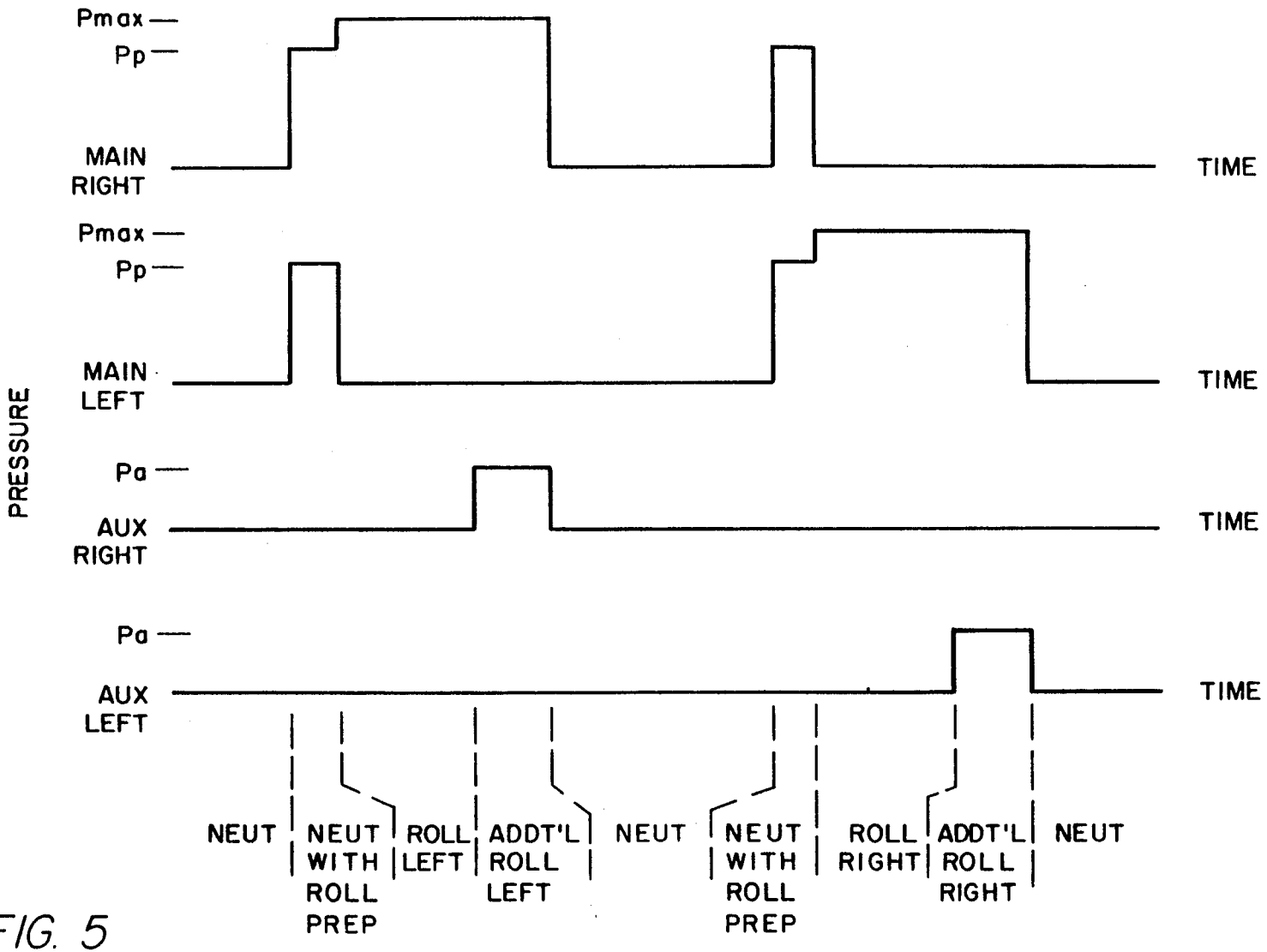
FIG. 5 is a timing diagram showing a representative cycle established by the air circuit of FIG. 4.

A typical time cycle for pressures in the main and auxiliary rolling chambers is illustrated in FIG. 5 for a sequence of roll left and roll right orientation interspersed with neutral orientations in which the patient lies flat on his back. In the diagram, $P_{max}$ is the maximum inflation pressure to which the main rolling chambers are exposed and it would be the pressure set by regulator 48 for the right main rolling chamber and regulator 56 for the left main rolling chamber. Typically, these would be equal, but if asymmetrical rolling is desired, the pressure can be adjusted individually for each. The roll preparation pressure $P_p$ is that established by regulator 50. Preparation pressure $P_p$ should be established at a level of least about 65% of the maximum pressure $P_{max}$. Preferably, $P_p$ is in a range of 80–85% of $P_{max}$. The auxiliary pressures $P_a$ in the diagram for the right or left auxiliary rolling chambers are established by regulators 60 and 62. The auxiliary pressure $P_a$ may be substantially less than $P_{max}$, and still increase the angle of patient roll. Zero pressure is established for any of the chambers by movement of exhaust valves 44, 52, 58, or 60 to atmosphere, so that the corresponding chamber is not connected to line 42.

Referring to the diagram of FIG. 5, the patient is sequentially taken through stages of neutral or flat, roll preparation, roll left, additional roll left, neutral, roll preparation, roll right and additional roll right in a complete cycle of turning. Initially, in each neutral phase, the rolling chambers 16, 18, 30 and 32 are deflated so that the patient is resting flat on his back supported by the conventional mattress 12. Thus, valves 44, 52, 58 and 60 are set to expose these chambers to atmosphere. In the latter stage of each neutral position, main rolling chambers are inflated to equal pressures $P_p$ by connecting valves 44 and 52 to valves 46 and 54, and by connecting valves 46 and 54 to roll preparation pressure regulator 50. This establishes the patient in the position in preparation for rolling depicted in FIGS. 1 through 3. The preparation for roll stage may be established as a minor part of the time of each neutral phase. For example, where each of the phases is to last an hour or two, the roll preparation phase at the end of the neutral phase might be of a few minutes duration. While the system will function by inflating the main rolling chambers 16 and 18 to $P_p$ throughout the neutral phase, it is not necessary to expose the patient to inflated air support throughout the prolonged neutral phase. Accordingly, it is preferable for patient comfort to establish the preparation stage only a short time before beginning a roll.

The next stage depicted in FIG. 5 is roll left, wherein the left main rolling chamber 16 is deflated by opening valve 52 to atmosphere, and the right main rolling chamber 18 is inflated to $P_{max}$ by shifting valve 46 to connect with regulator 48 which establishes the maximum pressure. This orientation of the main rolling chambers is maintained throughout the roll left phase. If it is desired to increase the angle of the patient's roll to the left, the auxiliary rolling chamber 32 may be inflated during this stage to create an additional roll left stage. It is carried out by connecting valve 58 to regulator 60 establishes pressure $P_a$. At the end of the roll left stages, all rolling chambers are deflated to return the patient to the neutral position as at the beginning of the timing diagram. At the end of this neutral stage, the rolling chambers are once again inflated to roll preparation pressure $P_p$ prior to commencing the roll right stage. The roll right stage is initiated by opening valve 44 to atmosphere, deflating the main right rolling chamber, and switching valve 54 to maximum pressure regulator 46 for the left side. The auxiliary right rolling chamber 30 may be pressurized in part or all of this stage to increase the angle of patient roll. Throughout all stages of patient movement, the leg separation chamber, outriggers and head rest are maintained in their inflated condition to produce enhancement of patient comfort and security.

Utilization of this system has been found to produce superior results in patient movement. Establishment of the preparation stage in the patient neutral position prior to commencing roll, in combination with the uninflated web 20 and outrigger chambers 36 has a number of beneficial effects. The patient is maintained in a relatively high degree of comfort. Feelings of insecurity arising from the underlying motions and angle of turn are minimized. The possibility of the patient being turned outwardly against side rails at the edge of the bed is minimized, and the security of outrigger cushions is provided. The patient rotation is accomplished with a minimum of sliding movement and sheer pressure on the patient's skin.

Figure 6:
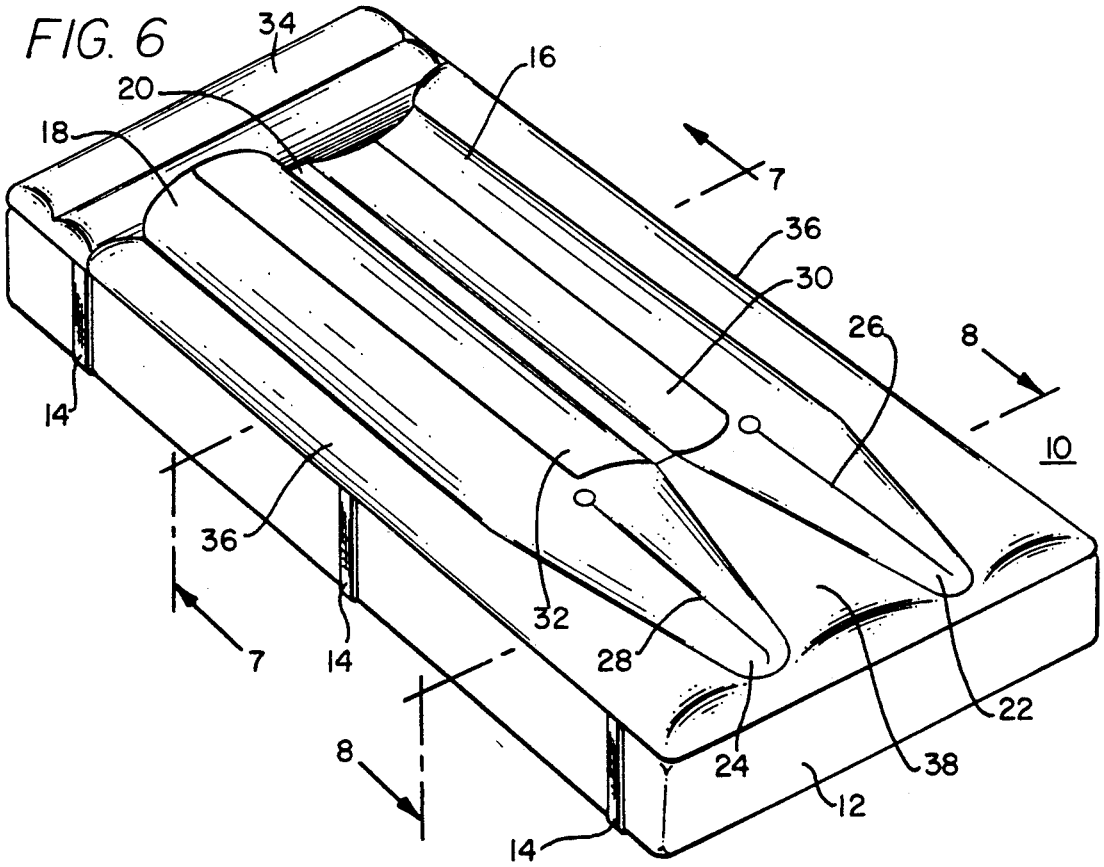
FIG. 6 is a perspective view similar to FIG. 1, but with the overlay in roll left condition.
Figure 7:
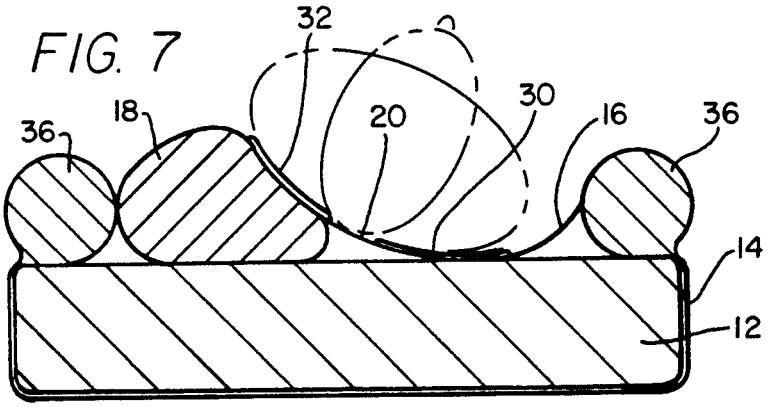
FIG. 7 is a cross-sectional view taken along line 7—7 in FIG. 6, showing the patient in phantom.
Figure 8:
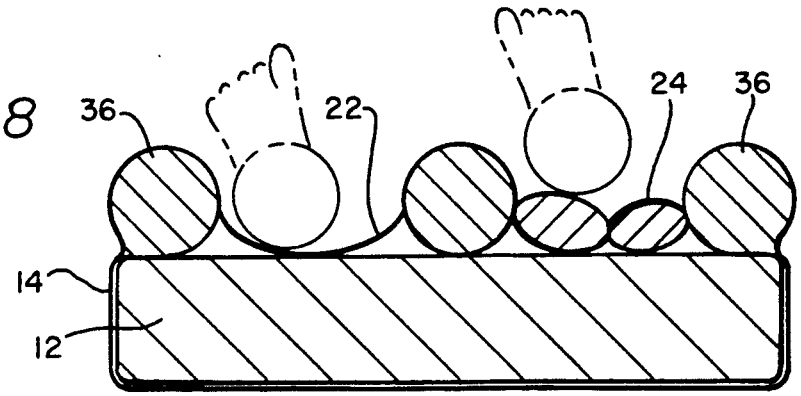
FIG. 8 is a cross-sectional view taken along line 8—8 in FIG. 6.
Figure 9:
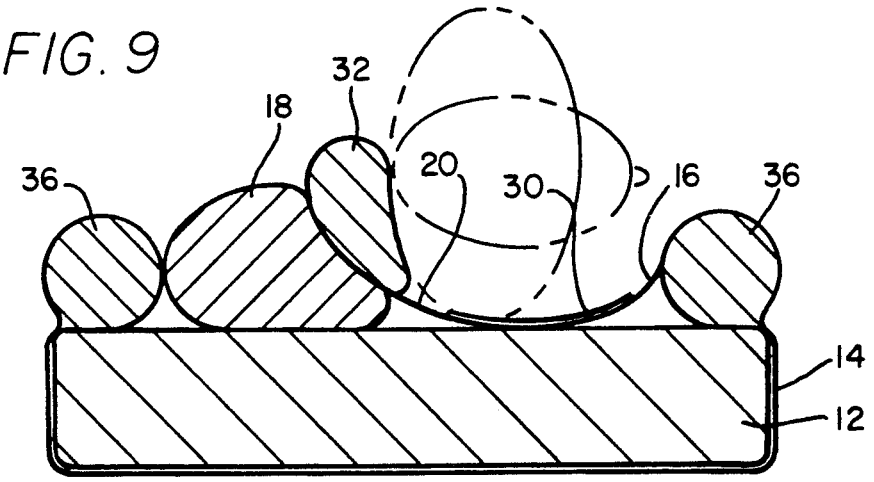
FIG. 9 is a view similar to FIG. 7, with the auxiliary rolling chamber inflated to increase the angle of patient roll.

The rolling mode carried out by one roll stage of the apparatus is depicted in FIGS. 6 through 8. The patient is carried to a mild degree of turn by inflation of main rolling chamber 18, with the security of inflated outriggers 36. FIG. 9 illustrates the greater angle of turn achieved when the auxiliary chamber 32 is inflated, increasing the rotation, while still minimizing the sliding motion of the patient.

Whereas the present invention has been described with respect to a specific embodiment thereof, it will be understood that various changes and modifications will be suggested to one skilled in the art and it is intended to encompass such changes and modifications as fall within the scope of the appended claims.

I claim:

1. A patent rolling overlay air mattress system for use with a bed comprising:

(a) an air source;

(b) an air mattress overlay including:

(i) left and right parallel main rolling chambers extending longitudinally at least the length of a patent torso, and being spaced apart at least about two inches by a central uninflatable web connecting the two chambers;

(ii) a pair of outrigger chambers, each extending along the outside of a main rolling chamber;

(iii) a leg separation chamber extending centrally of the overlay longitudinally downwardly from the lower end of the web separating the main rolling chambers;

(iv) a pair of leg support chambers located on each side of the leg separation chamber, each comprising an extension of a main rolling chamber; and (c) control means connected to the air source and the overlay for directing air to and from the chambers in the overlay, at first times deflating the left main rolling chamber while inflating the right main rolling chamber, and at second times inflating the left main rolling chamber while deflating the right main rolling chamber, and at both said first and second times maintaining inflation of the leg separation chamber and at least one outrigger chamber.

2. The system of claim 1 wherein the control means causes the inflated main rolling chamber at said first and second times to be inflated to a predetermined pressure P, and the control means establishes a partial inflation of both main rolling chambers immediately prior to said first and second times, with both main rolling chambers established at a substantially equal pressure of at least about 0.65 P.

3. The system of claim 1, further including a pair of auxiliary roller chambers, one overlying each main rolling chamber, wherein the user may select inflation of an auxiliary rolling chamber to increase the angle of patient roll.

4. A patient rolling overlay air mattress system for use with a bed comprising:

(a) an air source;

(b) an air mattress overlay including left and right parallel main rolling chambers extending longitudinally at least the length of a patient torso;

(c) control means connected to the air source and the overlay for directing air to and from the chambers in the overlay, at first times deflating the left main rolling chamber while inflating the right main rolling chamber to full inflation pressure, and at second times inflating the left main rolling chamber to full inflation pressure while deflating the right main rolling chamber; and (d) automatic roll preparation means included in said control means, operable automatically at times immediately prior to each of said first and second times, for maintaining partial inflation of both main rolling chambers at a pressure of at least about 65% of full inflation pressure.

5. A patient rolling overlay air mattress system for use with a bed comprising:

(a) an air source;

(b) an air mattress overlay including left and right main rolling chambers extending longitudinally at least the length of a patient torso, and a pair of outrigger chambers, each extending along the outside of a rolling chamber; and (c) control means for directing air to and from the chambers in the overlay, at first times deflating the left main rolling chamber while inflating the right main rolling chamber, and at second times inflating the left main rolling chamber while deflating the right main rolling chamber, and at both said first and second times maintaining inflation of at least the outrigger chamber corresponding to the deflated main rolling chamber.

6. A patient rolling overlay for use with a bed comprising left and right parallel main rolling chambers extending longitudinally at least the length of a patient torso, and being spaced apart by no more than about five inches;

a pair of auxiliary roll chambers, one overlying each of the main rolling chambers; and a pair of outrigger chambers, each extending along the outside of a rolling chamber; and separate air inlet at each main rolling chamber and auxiliary rolling chamber for permitting separate inflation of each chamber independent of the other.

7. A patient rolling overlay for use with a bed comprising:

(a) left and right parallel main rolling chambers extending longitudinally at least the length of a patient torso, and being spaced apart at least about two inches by a central uninflatable web connecting the two chambers;

(b) a pair of outrigger chambers, each extending along the outside of a rolling chamber;

(c) a leg separation chamber extending centrally of the overlay longitudinally downwardly from the lower end of the web separating the main rolling chambers;

(d) a pair of leg support chambers located on each side of the leg separation chamber, each comprising an extension of a main rolling chamber; and (e) a pair of auxiliary rolling chambers, one overlying each of the main rolling chambers.

8. A patient rolling overlay air mattress system for use with a bed comprising:

(a) an air source;

(b) an air mattress overlay including left and right parallel main rolling chambers extending longitudinally at least the length of a patient torso;, and being spaced apart at least about two inches by a central uninflatable web connecting the two chambers and an auxiliary rolling chamber overlying each of the main rolling chambers and underlying the patient;

(c) control means for directing air to and from the chambers in the overlay, at first times deflating the left main rolling chamber while inflating the right main rolling chamber, and at second times inflating the left main rolling chamber while deflating the right main rolling chamber; and (d) user selection means for causing additional roll by selective inflation of one of said auxiliary rolling chambers at said first or second times.

* * * * *